US007365684B2

(12) United States Patent
Liang et al.

(10) Patent No.: US 7,365,684 B2
(45) Date of Patent: Apr. 29, 2008

(54) ANTENNA HAVING A FILTER AND A SIGNAL FEED-IN POINT

(75) Inventors: Jia-Haur Liang, Kaohsiung (TW); Ting-Yi Tsai, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 64 days.

(21) Appl. No.: 11/255,657

(22) Filed: Oct. 21, 2005

(65) Prior Publication Data

US 2006/0273975 A1 Dec. 7, 2006

(30) Foreign Application Priority Data

Jun. 1, 2005 (TW) ..... 94118077 A

(51) Int. Cl.
*H01Q 1/38* (2006.01)

(52) U.S. Cl. ..... 343/700 MS; 343/795; 343/909

(58) Field of Classification Search ..... 343/700 MS, 343/795, 909
See application file for complete search history.

(56) References Cited

U.S. PATENT DOCUMENTS 5,896,563 A * 4/1999 Kawanami et al. ..... 455/82
6,466,172 B1 * 10/2002 Ryken et al. ..... 343/700 MS
6,529,092 B2 * 3/2003 Fuke et al. ..... 333/99 S
6,603,373 B2 * 8/2003 Tsujiguchi ..... 333/204
6,630,907 B1 * 10/2003 Ryken et al. ..... 343/700 MS
6,954,177 B2 * 10/2005 Channabasappa et al. ..... 343/700 MS
7,102,586 B2 * 9/2006 Liang et al. ..... 343/795
7,138,949 B1 * 11/2006 Ryken et al. ..... 343/700 MS
7,205,894 B1 * 4/2007 Savage ..... 340/568.6
2003/0197653 A1 * 10/2003 Barber et al. ..... 343/742

* cited by examiner

*Primary Examiner*—Tan Ho
(74) *Attorney, Agent, or Firm*—Thomas, Kayden, Horstemeyer & Risley

(57) ABSTRACT

An antenna structure used in an electronic device includes a signal transmission line and an antenna unit. The signal transmission line is electrically coupled to the electronic device. The antenna unit includes a signal feed-in point, a filter, and a radiation part. The signal feed-in point is electrically coupled to the electronic device via the signal transmission line. The filter has a first end electrically coupled to the signal feed-in point. The radiation part is electrically coupled to a second end of the filter.

21 Claims, 4 Drawing Sheets

Frequency (MHz) : 2450.00 Antenna Polarity : Vertical Average Gain (dB) : 2.36

Maximum Gain (dB) : 3.11 Maximum Gain (degree) : 234

Minimum Gain (dB) : 1.76 Minimum Gain (degree) : 87

ANTENNA HAVING A FILTER AND A SIGNAL FEED-IN POINT

This application claims the benefit of Taiwan application Ser. No. 94118077, filed Jun. 1, 2005, the subject matter of which is incorporated herein by reference.

BACKGROUND OF THE INVENTION

1. Field of the Invention

The invention relates in general to an antenna structure, and more particularly to an antenna structure having a filter.

2. Description of the Related Art

Today people lay much stress on life technology, and thus are more and more focusing attention to how to effectively enhance convenience of human lives. The good or bad in antenna structure design affects directly transmission and reception of wireless signals. Therefore, how to design an antenna structure of good quality has become an essential subject for wireless technology.

FIG. 1 is a schematic diagram of the conventional antenna structure. The antenna structure 100, such as a detachable antenna, is electrically coupled to an electronic device (not shown in the figure) of a wireless station. The antenna structure 100 includes an antenna unit 110 and a signal transmission line 120. The antenna unit 110, such as formed on a printed circuit board, includes a signal feed-in point 130 and a radiation body 150. The signal transmission line 120 has one end electrically coupled to the signal feed-in point 130 of the antenna unit 110 and the other end coupled connected to a plug 122 and the electronic device. The radiation part 150 is electrically coupled to the signal feed-in point 130.

The conventional antenna of the above-mentioned structure has a gain about 2 dBi. Besides, owing that the electronic device usually has more than one frequency band, for example, a wireless station capable of receiving signals having frequency 2.3 G~2.6 G or 4.9 G~6 G, an electronic device usually requires more than one antenna structure 100 for transmitting or receiving wireless signals in different frequency bands. However, an electronic device having more than one antenna structure 100 of different frequency bands will easily cause an electro-magnetic coupling effect and wireless signals of different bands will thus interfere with each other.

In order to prevent the above-mentioned electronic device having the antenna structure 100 of different frequency bands from causing the electromagnetic coupling effect, a filter is usually disposed on the printed circuit board of the electronic device and coupled to the antenna structure 100. However, disposition of the filter will enlarge the printed circuit board of the electronic device and thus increase its manufacturing cost.

SUMMARY OF THE INVENTION

It is therefore an object of the invention to provide an antenna structure. On one hand, a filter is disposed on the antenna structure to filter signals of unexpected frequency bands, on the other hand, the filter is disposed at an area of the printed circuit board having larger open space, thereby simultaneously preventing the electro-magnetic coupling effect and solving the issue on circuit layout.

The invention achieves the above-identified object by providing an antenna structure used in an electronic device. The antenna structure includes a signal transmission line and an antenna unit. The signal transmission line is electrically coupled to the electronic device. The antenna unit includes a signal feed-in point, a filter, and a radiation part. The signal feed-in point is electrically coupled to the electronic device via the signal transmission line. The filter has a first end electrically coupled to the signal feed-in point. The radiation part is electrically coupled to a second end of the filter.

The invention achieves the above-identified object by providing an antenna structure used in an electronic device. The antenna structure includes a signal transmission line and an antenna unit. The signal transmission line is electrically coupled to the electronic device. The antenna unit includes a signal feed-in point, a first filter, a first radiation part, a second filter, and a second radiation part. The first filter has a first end electrically coupled to the signal feed-in point. The first radiation part is electrically coupled to a second end of the first filter. The second filter has a first end electrically coupled to the signal feed-in point. The second radiation part is electrically coupled to a second end of the second filter.

Other objects, features, and advantages of the invention will become apparent from the following detailed description of the preferred but non-limiting embodiments. The following description is made with reference to the accompanying drawings.

DETAILED DESCRIPTION OF THE INVENTION

Embodiment One

Figure 1:
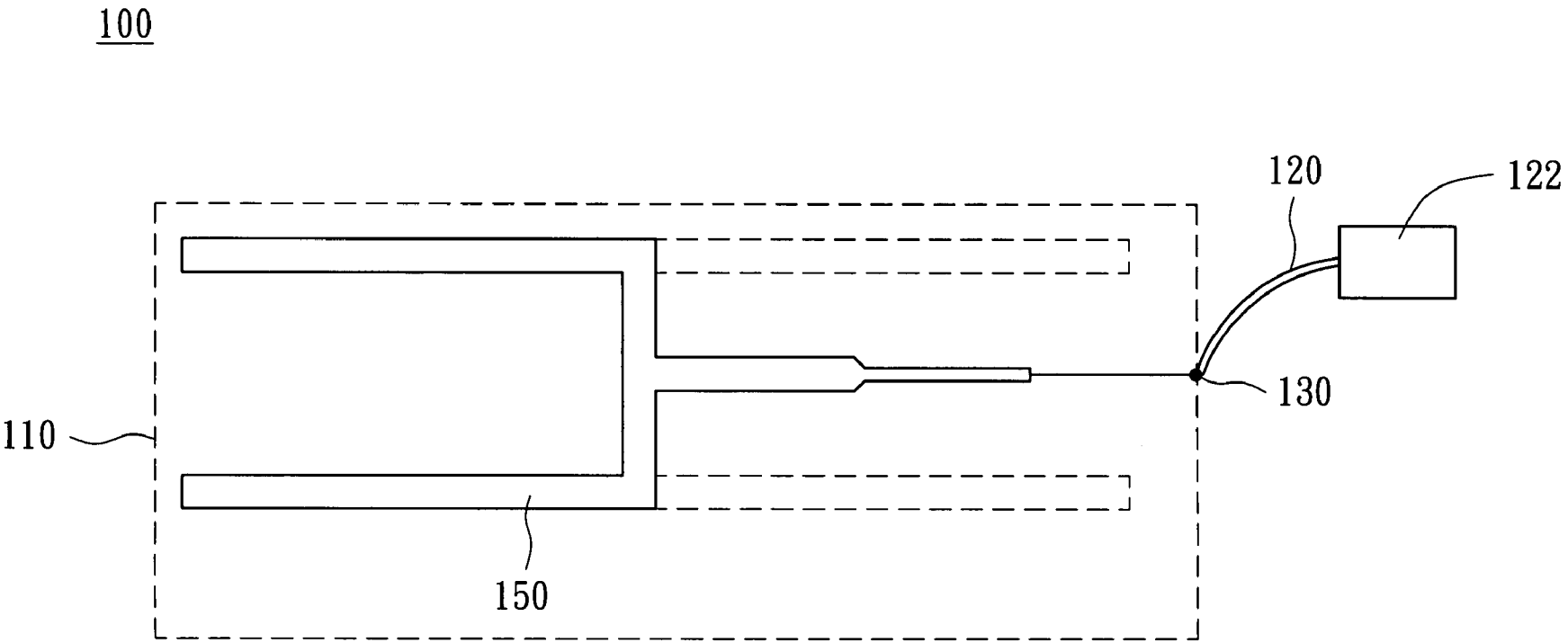
FIG. 1(PRIOR ART)
FIG. 1 is a schematic diagram of the conventional antenna structure.
Figure 2:
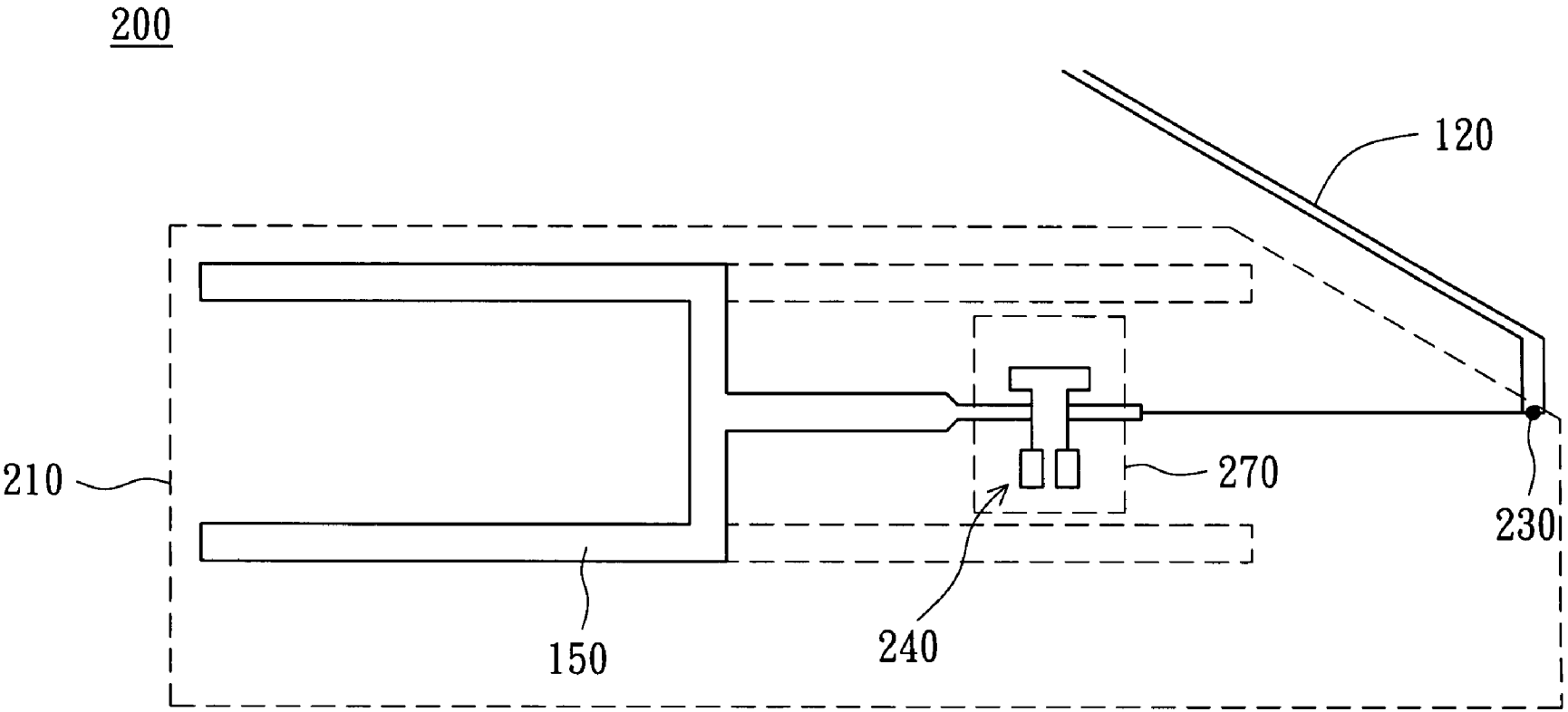
FIG. 2 is a schematic diagram of an antenna structure according to the first embodiment of the invention.

Referring to FIG. 2, a schematic diagram of an antenna structure according to the first embodiment of the invention is shown. The antenna structure 200 includes a signal transmission line 120 and an antenna unit 210. The signal transmission line 120 has one end electrically coupled to an electronic device (not shown in the figure) and the other end electrically coupled to the antenna unit 210. The antenna unit 210 includes a signal feed-in point 230, a filter 240 and a radiation part 150. The filter 240 has a first end electrically coupled to the signal feed-in point 230 and a second end electrically coupled to the radiation part 150.

Furthermore, the radiation part 150 and the filter 240 of the antenna structure 200 are formed by etching a glass fiber substrate (FR4) of the printed circuit board (PCB), and a ground area 270 is configured on the printed circuit board corresponding to the filter 240. The radiation part 150, a dipole antenna, is a radiation part of approximate H-pattern formed by etching the upper surface and lower surface of the printed circuit board. The filter 240 is composed of micro-strip lines and can be a low pass filter, high pass filter, all pass filter, band pass filter, or band stop filter, as required.

In addition, the electronic device using the antenna structure 200 can be an access point (AP) of a wireless area network. According to specification of the institute of electronic and electronics engineers (IEEE), the wireless area network has standard 802.11a/b/g. The standard 802.11a is applied to the frequency band of 4.9~6 GHz while the standard 802.11b/g is applied to the frequency band of 2.3~2.6 GHz. Because the antenna structure 200 is a single-frequency antenna, when the antenna structure 200 is operated at the band of 4.9~6 GHz in the standard 802.11a, signals having frequency 2.3~2.6 GHz has to be filtered by the filter 240. On the contrary, when the antenna structure 200 is operated at the band of 2.3~2.6 GHz in the standard 802.11b/g, signals having frequency 4.9~6 GHz should be filtered by the filter 240.

Embodiment Two

Figure 3:
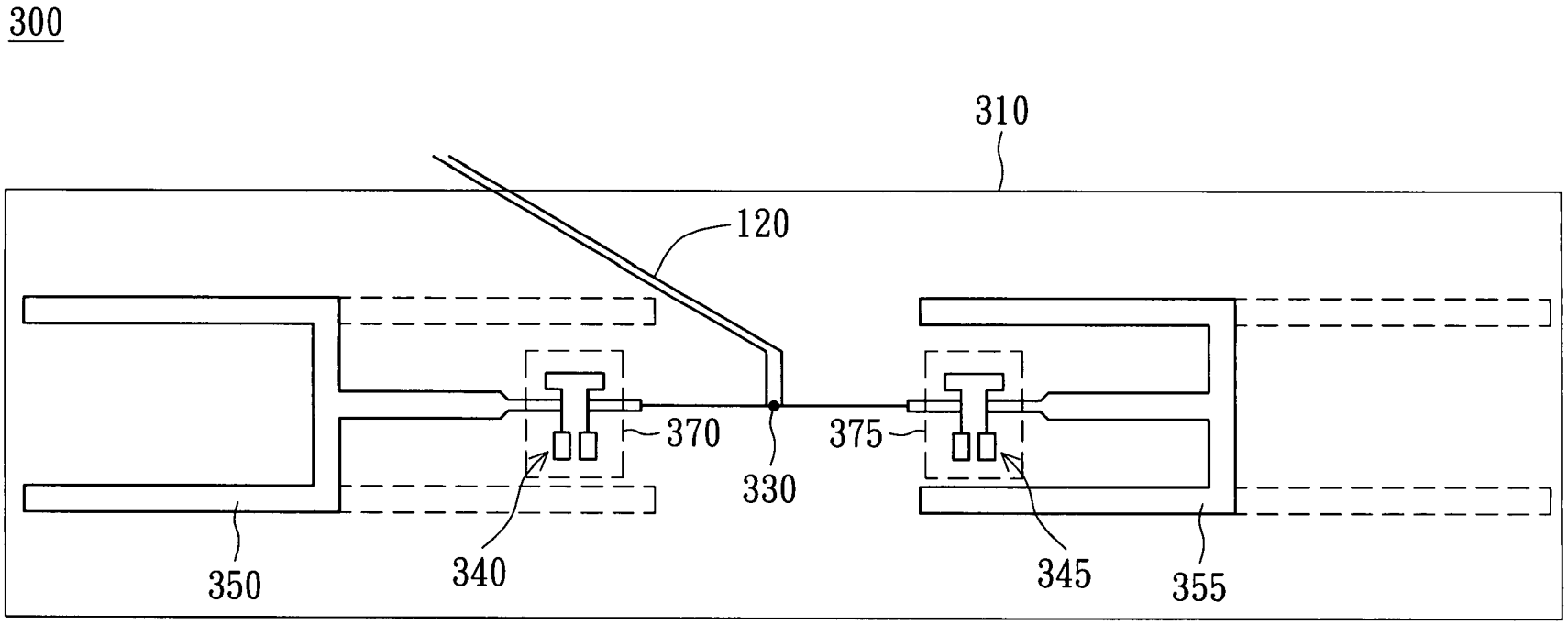
FIG. 3 is a schematic diagram of an antenna structure according to the second embodiment of the invention.

Referring to FIG. 3, a schematic diagram of an antenna structure according to the second embodiment of the invention is shown. The antenna structure 300 includes a signal transmission line 120 and an antenna unit 310. The antenna unit 310 includes a signal feed-in point 330, a first filter 340, a first radiation part 350, a second filter 345, and a second radiation part 355. The signal transmission line is electrically coupled to an electronic device (not shown in the figure) and the signal feed-in point 330.

Furthermore, the antenna unit 310 is formed by etching a glass fiber substrate of a printed circuit board, wherein a first ground area 370 and a second ground area 375 are configured on the printed circuit board respectively corresponding to the first filter 340 and the second filter 345. The first radiation part 350 and the second radiation part 355 are dipole antennas and the first radiation part 350 and the second radiation part. 355 are radiation parts of approximate H-pattern formed by etching the upper surface and the lower surface of the printed circuit board. The first filter 340 and the second filter 345 are composed of micro-strip lines and can be a low pass filter, a high pass filter, all pass filter, band pass filter, or band stop filter, as required.

When the antenna structure 300 is operated at the band of 4.9~6 GHz in the standard 802.11a, the first filter 340 and the second filter 345 are used to filter signals of 2.3~2.6 GHz. On the contrary, when the antenna structure 300 is operated at the band of 2.3~2.6 GHz in the standard 802.11b/g, the first filter 340 and the second filter 345 are used to filter signals of 4.9~6 GHz.

Figure 4:
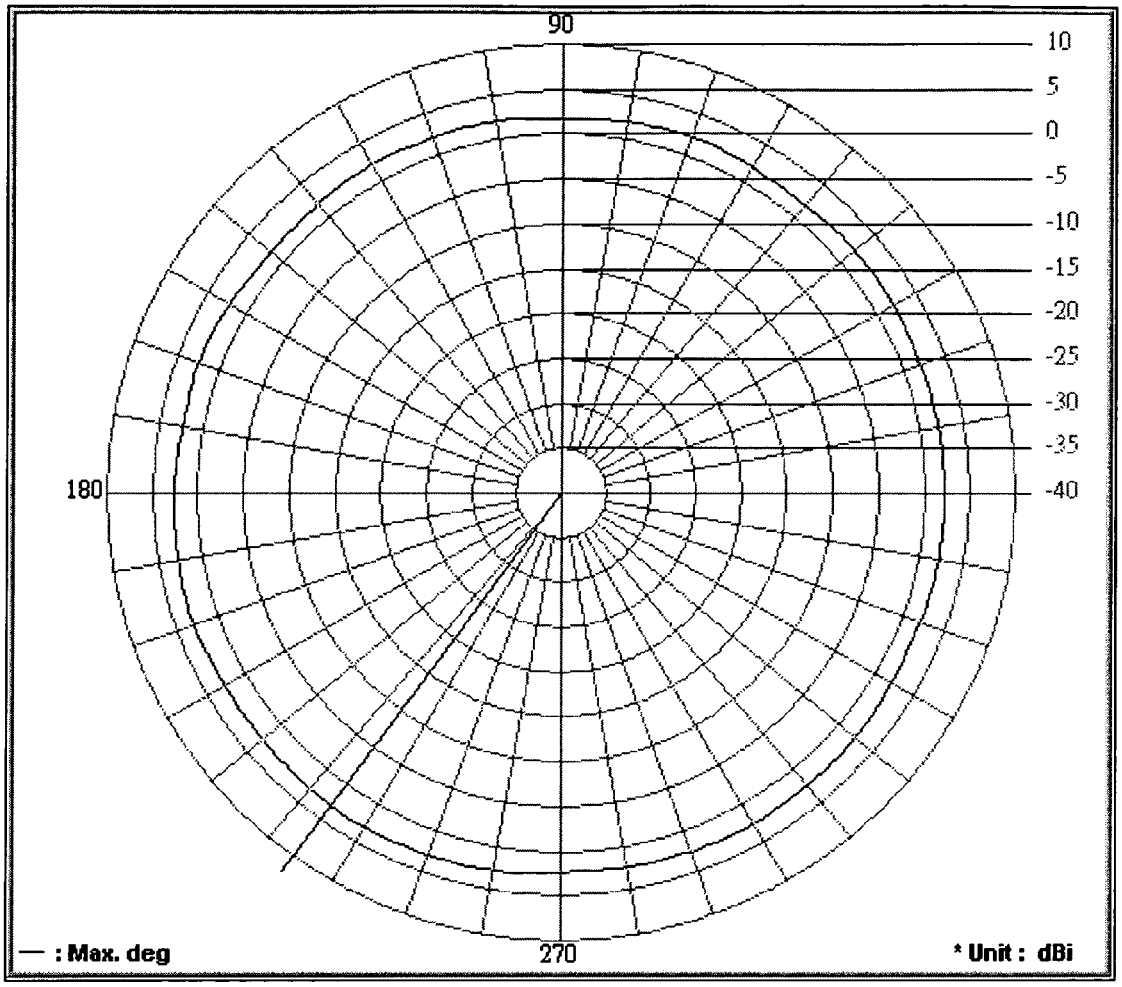
FIG. 4 is a gain measurement diagram of the antenna structure according to the second embodiment of the invention.

Except that the invention can effectively filter signals of unexpected frequency bands to operate the antenna structure 300 in a normal condition, the invention can improve antenna gain. Referring to FIG. 4, a gain measurement diagram of the antenna structure according to the second embodiment of the invention is shown. In FIG. 4, some parameters of the antenna structure 300 in the second embodiment are measured by using a measuring instrument. It can be seen that the antenna of the invention has a gain up to 3.11 dBi. As compared to the conventional antenna having a gain 2 dBi, the antenna structure of the invention can transmit signals more clearly.

According to the above-mentioned embodiment of the invention, the antenna structure can filter wireless signals of unexpected frequency bands to prevent the electro-magnetic coupling effect generated as the electronic device an antenna structure of more than two frequency bands by integrating a filter into the printed circuit board of the antenna unit. Besides, the invention can simplify the researching and developing process of the electronic device using the antenna structure so that the R&D staffs have more flexibility in circuit layout of the printed circuit board of the electronic device.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna structure, used in an electronic device, comprising:
- a signal transmission line, for electrically coupling to the electronic device; and
- an antenna unit, formed by etching a printed circuit board, the antenna unit comprising:
  - a signal feed-in point, for electrically coupling to the electronic device via the signal transmission line;
  - a filter, having a first end and a second end, wherein the first end is electrically coupled to the signal feed-in point; and
  - a radiation part, electrically coupled to the second end of the filter, wherein the filter is disposed between the signal feed-in point and the radiation part, the filter is integrated into the antenna unit, and the filter and the radiation part are formed by etching the printed circuit board as an integral portion of the antenna unit.

2. The antenna structure according to claim 1, wherein the filter is composed of micro-strip lines.

3. The antenna structure according to claim 1, being a single-frequency antenna.

4. The antenna structure according to claim 1, having an operation frequency of 2.3~2.6 GHz, wherein the filter filters signals having a frequency band of 4.96~6 GHz.

5. The antenna structure according to claim 1, having an operation frequency of 4.9~6 GHz, wherein the filter filters signals having a frequency band of 2.3~2.6 GHz.

6. The antenna structure according to claim 1, wherein the radiation part is a H-pattern radiation part.

7. The antenna structure according to claim 1, wherein the radiation part is a dipole antenna.

8. The antenna structure according to claim 1, wherein the electronic device is an access point of a wireless area network.

9. The antenna structure according to claim 1, wherein the filter and the radiation part are formed on a first surface of the printed circuit board, and the antenna structure further comprises a ground area on a second surface of the printed circuit board corresponding to the filter.

10. An antenna structure, used in an electronic device, comprising:
- a signal transmission line, for electrically coupling to the electronic device; and
- an antenna unit, comprising:
  - a signal feed-in point;
  - a first filter, having a first end electrically coupled to the signal feed-in point;
  - a first radiation part, for electrically coupling to a second end of the first filter;
  - a second filter, having a first end electrically coupled to the signal feed-in point; and
  - a second radiation part, for electrically coupling to a second end of the second filter.

11. The antenna structure according to claim 10, wherein the antenna unit is formed by etching a printed circuit board.

12. The antenna structure according to claim 11, wherein the antenna structure further comprises a first ground area and a second ground area configured on the printed circuit board corresponding to the first filter and the second filter respectively.

13. The antenna structure according to claim 10, wherein the first filter and the second filter are composed of micro-strip lines.

14. The antenna structure according to claim 10, having an operation frequency of 2.3~2.6 GHz, wherein the first filter and the second filter filters signals having a frequency band of 4.9~6 GHz.

15. The antenna structure according to claim 10, having an operation frequency of 4.9~6 GHz, wherein the first filter and the second filter filter signals having a frequency band of 2.3~2.6 GHz.

16. The antenna structure according to claim 10, being applied to specification 802.11a/b/g.

17. The antenna structure according to claim 10, wherein the first radiation part and the second radiation part are H-pattern radiation parts.

18. The antenna structure according to claim 10, wherein the first radiation part and the second radiation part are dipole antennas.

19. The antenna structure according to claim 10, wherein the electronic device is an access point of a wireless area network.

20. The antenna structure according to claim 10, wherein the first filter is disposed between the signal feed-in point and the first radiation part.

21. The antenna structure according to claim 20, wherein the second filter is disposed between the signal feed-in point and the second radiation part.

* * * * *